US008534571B2

(12) United States Patent
Schwartz et al.

(10) Patent No.: US 8,534,571 B2
(45) **Date of Patent: *Sep. 17, 2013**

(54) SWITCHABLE RADIATOR BYPASS VALVE SET POINT TO IMPROVE ENERGY EFFICIENCY

(75) Inventors: William Schwartz, Pleasant Ridge, MI (US); Chendong Huang, Ann Arbor, MI (US); Stephen Fan, Chongging (CN); Upendra Patel, Canton, MI (US); Ken Jackson, Dearborn, MI (US); Joseph Stanek, Northville, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 35 days.

This patent is subject to a terminal disclaimer.

(21) Appl. No.: 12/984,692

(22) Filed: Jan. 5, 2011

(65) Prior Publication Data

US 2011/0094707 A1 Apr. 28, 2011

Related U.S. Application Data

(62) Division of application No. 11/170,935, filed on Jun. 29, 2005, now Pat. No. 7,886,988.

(60) Provisional application No. 60/622,650, filed on Oct. 27, 2004.

(51) Int. Cl.

| | |
|---|---|
| ***B60H 1/10*** | (2006.01) |
| *B60H 1/04* | (2006.01) |
| *B60H 1/08* | (2006.01) |
| *F01P 3/04* | (2006.01) |

(52) U.S. Cl.
USPC ..... 237/12.3 B; 237/12.3 R; 237/5; 237/8 R; 123/41.1; 165/202

(58) Field of Classification Search
CPC ..... B60H 1/00914; B60H 1/032; B60H 1/02; F01P 3/18
USPC ..... 237/5, 12.3 B, 12.3 R, 2 A, 8 A, 237/8 C, 8 R, 9 A, 62; 123/41.1; 165/202
IPC ..... B60H 1/10, 1/02, 1/04, 1/08; F01P 3/04
See application file for complete search history.

(56) References Cited

U.S. PATENT DOCUMENTS 2,102,940 A * 12/1937 Buchanan ..... 237/19
2,355,040 A * 8/1944 Alexander et al. ..... 165/256

(Continued)

FOREIGN PATENT DOCUMENTS

JP 100089071 A 4/1998
JP 2004285830 * 4/1998
JP 2004285830 A 10/2004

*Primary Examiner* — Kang Hu
*Assistant Examiner* — Daniel E Namay
(74) *Attorney, Agent, or Firm* — David Kelley, Esq.; Tung & Associates

(57) ABSTRACT

A method of conserving energy during a heating event wherein a coolant is heated in a cooling system is disclosed. The method includes establishing a first set point temperature for a first point in the cooling system and establishing a second set point temperature lower than the first set point temperature for a second point in the cooling system. Normally, the coolant is maintained at the second set point temperature at the second set point in the cooling system. During the heating event, the second set point temperature is raised to substantially match the first set point temperature to reduce necessary heating of the coolant at the first point.

14 Claims, 1 Drawing Sheet

(56) References Cited

U.S. PATENT DOCUMENTS

| | | | | |
|---|---|---|---|---|
| 4,517,929 | A * | 5/1985 | Musick et al. | 123/41.1 |
| 5,174,254 | A * | 12/1992 | Humburg | 123/142.5 R |
| 5,203,498 | A * | 4/1993 | Kajikawa | 237/2 A |
| 5,537,956 | A | 7/1996 | Rennfeld | |
| 5,647,534 | A * | 7/1997 | Kelz et al. | 237/12.3 B |
| 6,078,107 | A * | 6/2000 | Kahnau et al. | 307/10.1 |
| 6,101,987 | A | 8/2000 | Saur | |
| 6,178,928 | B1 | 1/2001 | Corriveau | |
| 6,347,528 | B1 * | 2/2002 | Iritani et al. | 62/324.6 |
| 6,454,180 | B2 * | 9/2002 | Matsunaga et al. | 237/12.3 B |
| 6,464,027 | B1 * | 10/2002 | Dage et al. | 180/65.22 |
| 6,470,838 | B2 | 10/2002 | Ap | |
| 6,539,899 | B1 | 4/2003 | Piccirilli | |
| 6,638,031 | B1 * | 10/2003 | Humburg | 417/313 |
| 6,739,290 | B2 | 5/2004 | Iwaski | |
| 6,769,623 | B2 | 8/2004 | Ban | |
| 6,779,737 | B2 * | 8/2004 | Murray et al. | 237/2 A |
| 6,857,398 | B2 * | 2/2005 | Takagi et al. | 123/41.1 |
| 7,013,848 | B2 * | 3/2006 | Gentil-Kreienkamp et al. | 123/41.1 |
| 7,055,590 | B2 * | 6/2006 | Hara | 165/202 |
| 7,140,427 | B2 * | 11/2006 | Honda et al. | 165/202 |
| 7,520,320 | B2 * | 4/2009 | Itoh et al. | 165/202 |
| 7,886,988 | B2 * | 2/2011 | Schwartz et al. | 237/12.3 R |
| 2001/0013409 | A1 * | 8/2001 | Burk et al. | 165/240 |
| 2003/0089319 | A1 * | 5/2003 | Duvinage et al. | 123/41.02 |
| 2004/0069012 | A1 * | 4/2004 | Inoue | 62/500 |
| 2004/0187805 | A1 * | 9/2004 | Arisawa et al. | 123/41.14 |
| 2005/0077252 | A1 * | 4/2005 | Shih et al. | 210/767 |
| 2005/0178523 | A1 * | 8/2005 | Itoh et al. | 165/42 |
| 2005/0224018 | A1 * | 10/2005 | Gentil-Kreienkamp et al. | 123/41.1 |
| 2006/0086816 | A1 * | 4/2006 | Schwartz et al. | 237/12.3 R |
| 2006/0113071 | A1 * | 6/2006 | Weible | 165/202 |
| 2006/0248906 | A1 * | 11/2006 | Burk et al. | 62/160 |
| 2012/0145804 | A1 * | 6/2012 | Ishii et al. | 237/12.3 R |

* cited by examiner

SWITCHABLE RADIATOR BYPASS VALVE SET POINT TO IMPROVE ENERGY EFFICIENCY

CROSS-REFERENCE TO RELATED APPLICATIONS

This application claims the benefit of U.S. Provisional Application No. 60/622,650, filed Oct. 27, 2004, and is a divisional application of and claims priority to U.S. Utility application Ser. No. 11/170,935 filed on Jun. 29, 2005, now U.S. Pat. No. 7,886,988, entitled "SWITCHABLE RADIATOR BYPASS VALVE SET POINT TO IMPROVE ENERGY EFFICIENCY", the disclosure of which is herein incorporated by reference in its entirety.

FIELD OF THE INVENTION

The present invention relates to coolant systems for vehicles. More particularly, the present invention relates to a coolant temperature control method which utilizes matching of a valve temperature set point, which controls the temperature of a coolant flowing into a propulsion system, and a heater set point, which controls the temperature of a coolant flowing into a heater core, in heating situations and reversion of the valve temperature set point back to a value which is optimal for efficient operation of the propulsion system in non-heating situations.

BACKGROUND OF THE INVENTION

In an automotive cooling system, an electronically controlled valve or other flow control device may control the temperature of a coolant at one point in the system, such as at the entry point of the coolant into the propulsion system of a vehicle, for example. The temperature of the coolant at this point in the system, known as the valve temperature, can be measured by a temperature sensor. The valve or other flow control device may control the valve temperature of the coolant at this point, according to a target temperature or valve set point temperature, by varying the ratio of the quantity of coolant flowing through a radiator or other heat exchanger to the quantity of coolant bypassing the radiator or heat exchanger and flowing into the propulsion system of the vehicle.

Under certain operating conditions, there may be situations, which call for additional temperature requirements at another point in the cooling system. These situations could include, for example, situations in which cabin heating and/or windshield defrosting is/are required. One of these additional temperature requirements could be that of the coolant entering a heater core, which provides heated air to the vehicle cabin, for example. At this point in the system, a heater temperature of the coolant would be measured by a different temperature sensor than that used to measure the valve temperature. The heater temperature requirement at that point in the system, corresponding to a heater set point temperature, may be different from the valve temperature requirement. Furthermore, the cooling system may include a coolant heater, which can be operated to augment the heater temperature of the coolant in order to achieve the heater set point temperature requirement at this point in the system.

In heating situations, the coolant heater typically consumes energy in order to heat the coolant. In meeting heater set point temperature requirements, it is therefore desirable to minimize the quantity of energy consumed by the coolant heater in order to maximize vehicular energy efficiency. For various reasons, the valve set point temperature may be lower than the heater set point temperature. The situation can therefore arise in which the heater set point temperature calls for the addition of heat from the coolant heater whereas the valve set point temperature simultaneously calls for the dissipation of heat from the radiator. This can lead to reduced vehicular energy efficiency because the coolant heater is consuming energy to add heat to the coolant while the valve is distributing the coolant through the radiator in order to draw the heat back out of the coolant.

Therefore, a control strategy is needed in which the valve set point temperature changes to more closely match the heater set point temperature when a heating situation arises and reverts to a value, which is optimal for cooling of the propulsion system when a heating situation does not exist. Such a strategy would facilitate optimum energy efficiency throughout all operating conditions.

SUMMARY OF THE INVENTION

The present invention is generally directed to a novel method of conserving fuel during a heating event in a cooling system such as a vehicle cooling system. The method is suitable for use in an automotive coolant system having a propulsion system, such as an internal combustion engine or fuel cell stack, for example, and a coolant line, which distributes coolant into and out of the propulsion system. A coolant heater is provided in the coolant line for heating the coolant prior to distribution of the coolant into a heater core during a heating event. A valve is provided in the coolant line for selectively distributing the coolant through either a radiator, radiator bypass line that bypasses the radiator, or both.

According to the method of the invention, a heater set point temperature is initially established. The heater set point temperature is used to control the operation of the heater so as to raise the coolant temperature to the heater set point temperature during a heating event. A valve set point temperature is also established. The valve set point temperature determines whether the valve will distribute the coolant through the radiator to dissipate heat from the coolant, shunt the coolant through the radiator bypass line to retain heat in the coolant, or a combination of both.

In the absence of a heating event, the coolant system is normally operated according to the valve set point temperature. Therefore, the valve distributes the coolant through the radiator as needed, which dissipates excess heat from the coolant to subsequently facilitate absorption of heat by the coolant from the propulsion system to facilitate optimum energy efficiency and/or performance of the propulsion system. During a heating situation, the coolant heater is operated to heat the coolant prior to distribution of the coolant into the heater core. Accordingly, at the onset of the heating situation, the valve set point temperature is elevated to substantially match the heater set point temperature. Therefore, the valve shunts the coolant through the radiator bypass line such that heat is retained in the coolant. Consequently, the coolant heater consumes less vehicle energy than would have been the case had the elevation of the valve set point not occurred since the temperature of the coolant subsequently flowing into the coolant heater is now substantially the same as the heater set point temperature. When the heating situation no longer exists, the valve set point temperature returns to the original value to facilitate optimal energy efficiency and/or performance of the propulsion system efficiency.

BRIEF DESCRIPTION OF THE DRAWINGS

The invention will now be described, by way of example, with reference to the accompanying drawings, in which.

DETAILED DESCRIPTION OF THE INVENTION

Figure 1:
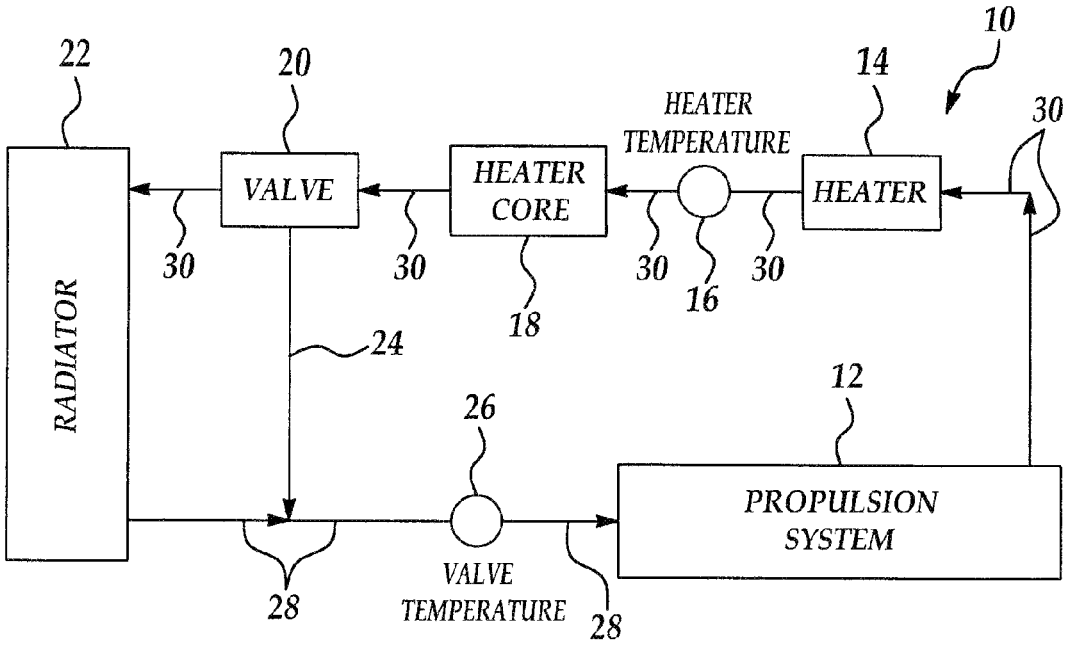
FIG. 1 is a schematic diagram of a vehicle coolant system in implementation of the present invention.

Referring initially to FIG. 1, a schematic diagram of a coolant system in implementation of the present invention is generally indicated by reference numeral 10. The coolant system 10 may be a vehicle coolant system, which is designed to absorb heat from a propulsion system 12, such as an internal combustion engine or a fuel cell stack, for example, which propels a vehicle. The propulsion system 12 is disposed in fluid communication with a coolant inlet line 28, which distributes a liquid coolant into the propulsion system 12, and a coolant outlet line 30, which distributes the coolant from the propulsion system 12. As used herein, the term "downstream" refers to the direction of coolant flow through the coolant inlet line 28 or coolant outlet line 30 of the vehicle coolant system 10.

A coolant heater 14 is typically provided in the coolant outlet line 30, downstream of the propulsion system 12. A heater core 18 is provided in the coolant outlet line 30, downstream of the coolant heater 14. A heater temperature sensor 16 is typically provided in the coolant outlet line 30, between the coolant heater 14 and the heater core 18. The heater core 18 provides for the thermal exchange of heat from coolant flowing through the coolant outlet line 30 to air which flows into the cabin of the vehicle, as is known by those skilled in the art. In operation of the vehicle coolant system 10, the heater temperature sensor 16 senses the temperature of the coolant in the coolant outlet line 30 prior to entry of the coolant into the heater core 18.

The inlet port of a three-way valve 20 is provided in fluid communication with the coolant outlet line 30, downstream of the heater core 18. The coolant outlet line 30 extends from one outlet port of the valve 20, whereas a radiator bypass line 24 extends from the other outlet port of the valve 20. The inlet of a radiator 22 or other heat exchanger is disposed in fluid communication with the coolant outlet line 30, downstream of the valve 20.

The coolant inlet line 28 is disposed in fluid communication with the outlet of the radiator 22 and with the coolant inlet of the propulsion system 12. The radiator bypass line 24 is confluently connected to the coolant inlet line 28, between the radiator 22 and the propulsion system 12. A valve temperature sensor 26 is provided in the coolant inlet line 28, typically between the radiator bypass line 24 and the propulsion system 12. In operation of the vehicle coolant system 10, the valve temperature sensor 26 measures the temperature of coolant flowing through the coolant inlet line 28 prior to entry of the coolant into the propulsion system 12.

In operation of the vehicle coolant system 10, coolant (not shown) is pumped from the coolant inlet line 28, through the propulsion system 12 and into the coolant outlet line 30, respectively, to absorb heat from the propulsion system 12 as the propulsion system 12 propels the vehicle. Under many circumstances, the heater 14 is not operated as the coolant flows through the heater 14 and the heater core 18, respectively. However, under circumstances in which a "heating situation" arises, as will be hereinafter described, the heater 14 is operated to augment heating of the coolant prior to distribution of the coolant into the heater core 18. A "heating situation" includes circumstances in which heated air is required for the cabin interior or for windshield defrosting purposes, for example. Accordingly, in a heating situation, the coolant heater 14 initiates heating of the coolant in the event that the heater temperature sensor 16 determines that the temperature of the coolant, referred to herein as the heater temperature, falls below a threshold value, referred to herein as the heater set point temperature.

Depending on the position of the valve 20, coolant flowing from the heater core 18 is distributed either through the radiator 22, in which case heat is dissipated from the coolant, or through the radiator bypass line 24, in which case heat is retained by the coolant, or a combination of the two. In the event that the temperature of the coolant as measured by the valve temperature sensor 26, referred to herein as the valve temperature, meets or exceeds a threshold value, referred to herein as the valve set point temperature, the valve 20 distributes some or all of the coolant through the radiator 22. On the other hand, in the event that the valve temperature falls below the valve set point temperature, the valve 20 distributes the coolant through the radiator bypass line 24, such that heat is retained by the coolant. The coolant then enters the propulsion system 12 to absorb heat from the propulsion system 12.

Under many operating circumstances, the valve temperature of the coolant at the valve temperature sensor 26 exceeds the valve set point temperature. Consequently, the valve 20 distributes some or all of the coolant through the radiator 22, thereby ensuring that the temperature of the coolant as it enters the propulsion system 12 is sufficiently low to facilitate absorption of heat from the propulsion system 12. This, in turn, may facilitate optimum energy efficiency and/or performance of the propulsion system 12.

In certain vehicle coolant system 10 operating conditions, the heater set point temperature, which controls operation of the coolant heater 14, is set higher than the valve set point temperature, which controls operation of the valve 20. Therefore, during a heating situation, the coolant heater 14 heats the coolant to such a degree that the heater temperature of the coolant, as measured by the heater temperature sensor 16, rises to the level of the heater set point temperature. This ensures that sufficient thermal exchange is conducted in the heater core 18 between the coolant and air to meet the heated air demands of the vehicle cabin.

Because the heater set point temperature is higher than the valve set point temperature, however, the valve temperature sensor 26 causes the valve 20 to distribute the coolant through the radiator 22 in order to dissipate heat from the coolant and lower the temperature of the coolant down to the valve set point temperature. Therefore, the valve temperature of the coolant, as measured by the valve temperature sensor 26, is less than the heater temperature of the coolant as previously measured by the heater temperature sensor 16. As the coolant emerges from the propulsion system 12, the actual temperature of the coolant is typically still below the heater set point temperature. Consequently, the heater 14 is required to consume energy in order to subsequently raise the temperature of the coolant distributed from the propulsion system 12 back up to the heater set point temperature prior to distribution of the coolant through the heater core 18.

Figure 2:
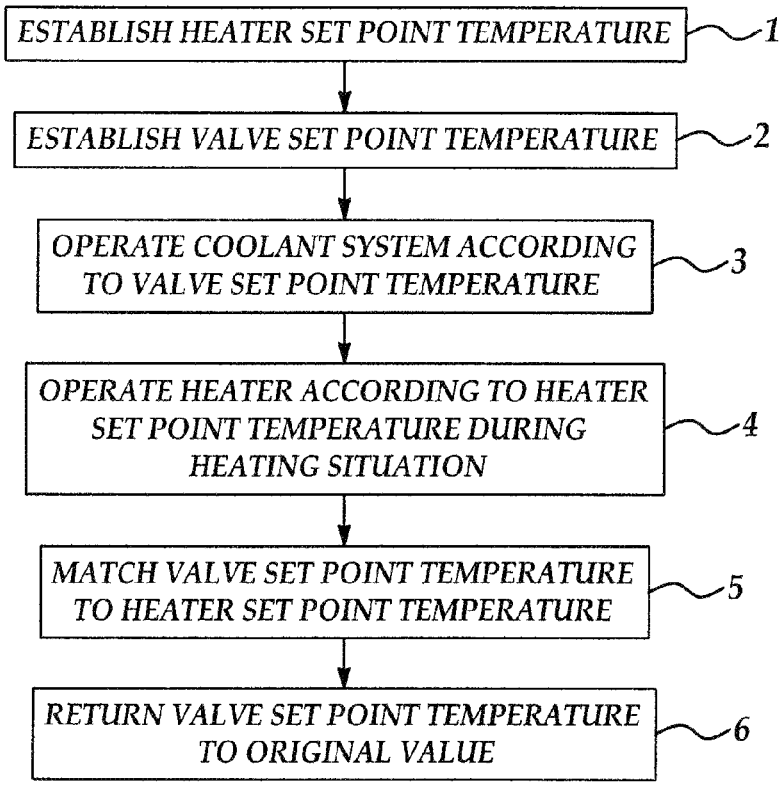
FIG. 2 is a flow diagram, which summarizes operational steps carried out according to the method of the present invention.

Referring next to FIG. 1, in conjunction with the flow diagram of FIG. 2, the method of the present invention is carried out by initially establishing a heater set point temperature for operation of the coolant heater 14, as indicated in step 1 of FIG. 2. Throughout operation of the vehicle, the heater set point temperature may change depending on the need for heated air inside the vehicle cabin for example. A valve set point temperature is also established for operation of the valve 20, as indicated in step 2. In step 3, in the absence of a heating situation, the vehicle coolant system 10 is operated according to the valve set point temperature. Accordingly, the valve 20 normally distributes the coolant through the radiator 22 to dissipate heat from the coolant. Therefore, the valve temperature of the coolant, as measured by the valve temperature sensor 26, drops and approaches or meets the valve set point temperature prior to distribution of the coolant into the propulsion system 12. In the event that the valve temperature of the coolant falls below the valve set point temperature, the valve 20 shunts the coolant through the radiator bypass line 24 to maintain the valve temperature of the coolant as close as possible to the valve set point temperature.

In the propulsion system 12, the coolant absorbs heat and then is distributed through the coolant outlet line 30. The valve set point temperature ensures that the valve temperature of the coolant flowing into the propulsion system 12 is such that absorption of heat from the propulsion system 12 by the coolant is sufficient to facilitate optimal energy consumption and/or performance from the propulsion system 12. In the absence of a heating situation, the coolant heater 14 is typically not operated to facilitate heated air demands inside the vehicle cabin. Therefore, in the absence of a heating situation, vehicle energy is typically not consumed by the coolant heater 14.

At the onset of a heating situation, however, the heater set point temperature requirements must now be met to facilitate the increased demand for heated air inside the vehicle cabin. Accordingly, the coolant heater 14 is operated to realize the heater set point temperature, which is typically higher than the valve set point temperature, as indicated in step 4 of FIG. 2. Accordingly, the coolant heater 14 augments the temperature of the coolant such that the heater temperature of the coolant rises and approaches or meets the raised or modified heater set point temperature. This heating of the coolant by the coolant heater 14 ensures that thermal exchange between the heated coolant and air in the heater core 18 is sufficient to meet the increased heated air demands inside the vehicle cabin.

As indicated in step 5, at the onset of the heating situation, the valve set point temperature is raised to establish a modified valve set point temperature, which substantially matches the heater set point temperature. Consequently, the valve 20 distributes the coolant substantially through the radiator bypass line 24 rather than substantially through the radiator 22. As a result, the valve temperature of the coolant remains at an elevated level as the coolant is distributed through the propulsion system 12, coolant outlet line 30 and coolant heater 14, respectively. Therefore, the heater temperature of the coolant, as measured by the heater temperature sensor 16, substantially meets the heater threshold temperature. Consequently, the coolant heater 14 either need not be operated at all, operated at a significantly reduced power, or only intermittently in order to maintain the heater temperature at or close to the heater set point temperature. This substantially reduces the consumption of vehicle energy by the coolant heater 14 throughout the heating situation.

When the heating situation is over, the heater set point temperature is no longer used to control the coolant temperature entering the heater core. Therefore, the coolant heater 14 is typically no longer operated to heat the coolant. As indicated in step 6 of FIG. 2, the valve set point temperature returns to the original value. Consequently, the valve 20 again distributes the coolant through the radiator 22 to dissipate excess heat from the coolant prior to distribution of the coolant into the propulsion system 12. This again facilitates optimum absorption of heat from the propulsion system 12 by the coolant, contributing to optimum energy consumption and/or performance of the propulsion system 12.

It is to be understood that the invention is not limited to the exact construction and method which has been previously delineated, but that various changes and modifications may be made without departing from the spirit and scope of the invention as delineated in the following claims.

What is claimed is:

1. A cooling system comprising:

a propulsion system;

a coolant heater connected in series to said propulsion system;

a heater core connected in series with said coolant heater and said propulsion system;

a radiator between said heater core and said propulsion system connected in series between said coolant heater, and said propulsion system, upstream of said propulsion system and downstream of said heater core;

a bypass line between said radiator and said propulsion system that bypasses said radiator, wherein said cooling system is configured to distribute a coolant between said radiator and said propulsion system based on a second set point temperature;

a first temperature sensor between said bypass line and said propulsion system to measure a first coolant temperature of coolant flowing into the propulsion system; and a second temperature sensor between said coolant heater and said heater core to measure a second coolant temperature of coolant flowing into said heater core, wherein said cooling system is configured to selectively operate said bypass line and said coolant heater based on said first and second coolant temperatures during a heating event thereby minimizing a quantity of energy consumed by the coolant heater; such that during a heating event, said first coolant temperature set point is adjusted to match said second temperature set point, said coolant flows through said radiator when said first coolant temperature is above said first temperature set point and bypasses said radiator when below said set point, and said coolant heater is energized when said second coolant temperature is below said second temperature set point and de-energized when said second temperature is above said second set point.

2. The cooling system of claim 1 wherein said cooling system comprises a vehicle cooling system.

3. The cooling system of claim 1 further comprising the second temperature sensor positioned at a point of entry of a coolant into said heater core.

4. The cooling system of claim 1 further comprising the first temperature sensor positioned at a point of entry of a coolant into said propulsion system.

5. The cooling system of claim 1 wherein said propulsion system comprises an internal combustion engine.

6. The cooling system of claim 1 wherein said propulsion system comprises a fuel cell stack.

7. The cooling system of claim 1 further comprising:

a bypass valve connected to said bypass line between said heater core and said radiator, upstream of said radiator and downstream of said heater core, wherein said bypass valve selectively allows distribution of coolant into the bypass line and into the propulsion system to distribute the coolant.

8. The cooling system of claim 1, wherein during a heating event, the cooling system is configured such that the radiator is selectively bypassed to raise a second set point temperature to match a first set point temperature such that the consumption of energy by the coolant heater to heat the coolant is eliminated or substantially reduced.

9. A cooling system for operating during a heating event comprising:

a propulsion system;

a coolant heater connected to said propulsion system;

a heater core connected in series with said coolant heater, and said propulsion system;

a first temperature sensor positioned at a first point in said cooling system for establishing a first set point temperature;

a second temperate sensor positioned at a second point in said cooling system for establishing a second set point temperature lower than said first set point temperature;

a heat exchanger in said coolant system between said heater core and said propulsion system connected between said coolant heater, and said propulsion system, upstream of said propulsion system and downstream of said heater core; and wherein during a heating event, the second set point temperature is raised to match the first set point temperature, and the cooling system is configured such that the heat exchanger is selectively bypassed when the second coolant temperature is below the second set point temperature by distributing a coolant between said heat exchanger and said propulsion system such that the consumption of energy by the heater to heat the coolant is eliminated or substantially reduced.

10. The cooling system for operating during a heating event according to claim 9 further comprising said first temperature sensor positioned at a point of entry of a coolant into said heater core.

11. The cooling system for operating during a heating event according to claim 9 further comprising said second temperature sensor positioned at a point of entry of a coolant into said propulsion system.

12. The cooling system for operating during a heating event according to claim 9 wherein said propulsion system comprises an internal combustion engine.

13. The cooling system for operating during a heating event according to claim 9 wherein said propulsion system comprises a fuel cell stack.

14. The cooling system for operating during a heating event according to claim 9 wherein said cooling system comprises a vehicle cooling system.

* * * * *